US008333352B2

(12) United States Patent
Chambers

(10) Patent No.: US 8,333,352 B2
(45) Date of Patent: Dec. 18, 2012

(54) BOTTLE HOLDER ASSEMBLY AND METHODS OF USE

(76) Inventor: Jeremy Chambers, Charlotte, NC (US)

( * ) Notice: Subject to any disclaimer, the term of this patent is extended or adjusted under 35 U.S.C. 154(b) by 0 days.

(21) Appl. No.: 12/893,442

(22) Filed: Sep. 29, 2010

(65) Prior Publication Data

US 2011/0101178 A1 May 5, 2011

Related U.S. Application Data

(60) Provisional application No. 61/246,794, filed on Sep. 29, 2009.

(51) Int. Cl.
*A47D 15/00* (2006.01)

(52) U.S. Cl. ..... 248/104; 248/102; 248/103; 248/205.2; 248/693

(58) Field of Classification Search ..... 248/102, 248/103, 104, 205.2, 693; 24/306, 3.2, 3.7, 24/3.9, 3.13; 215/396; 224/218, 148.1, 148.6; 294/24; 401/8
See application file for complete search history.

(56) References Cited

U.S. PATENT DOCUMENTS 3,368,811 A * 2/1968 Finney ..... 473/300
3,387,341 A * 6/1968 Mates et al. ..... 24/306
4,220,302 A * 9/1980 Hampton et al. ..... 248/102
4,414,692 A * 11/1983 Dzierson et al. ..... 2/160
4,447,912 A * 5/1984 Morrow ..... 2/159
4,504,980 A * 3/1985 Butcher ..... 2/160
4,548,375 A * 10/1985 Moss ..... 248/205.2
4,681,462 A * 7/1987 Lloyd ..... 368/69
4,718,623 A * 1/1988 McClure ..... 248/102
5,110,154 A * 5/1992 Street ..... 280/822
D357,801 S * 5/1995 Short ..... D3/215
5,542,588 A * 8/1996 Sison ..... 224/218
5,573,153 A * 11/1996 Stillman ..... 224/148.6
5,613,657 A * 3/1997 Olaiz ..... 248/102
5,695,380 A * 12/1997 Morrison ..... 446/268
5,845,374 A * 12/1998 Briggs ..... 24/442
5,862,927 A * 1/1999 Tebeau ..... 215/11.1
5,864,884 A * 2/1999 Salvitti ..... 2/159
5,890,636 A * 4/1999 Kibbe ..... 224/148.6
5,957,515 A * 9/1999 Van Der Sluys ..... 294/25
6,000,058 A * 12/1999 Iselin ..... 2/160
6,029,321 A * 2/2000 Fisher ..... 24/306
6,146,319 A * 11/2000 Tarail ..... 482/139
6,230,371 B1 * 5/2001 Chu ..... 24/197
6,325,237 B1 * 12/2001 Gish ..... 220/737
7,051,377 B1 * 5/2006 Milner et al. ..... 2/159
(Continued)

*Primary Examiner* — Terrell McKinnon
*Assistant Examiner* — Michael McDuffie
(74) *Attorney, Agent, or Firm* — Tillman Wright, PLLC; Chad D. Tillman; Jeremy C. Doerre

(57) ABSTRACT

A bottle holder assembly includes a first appendage component configured to be secured about a child's left hand via removable securement of one or more securement fasteners such that a coupling fastener is disposed over a child's palm facing outwards, and the child's fingers are not contained within the first appendage component. The bottle holder assembly further includes a second appendage component configured to be secured about a child's right hand via removable securement one or more securement fasteners such that a coupling fastener is disposed over a child's palm facing outwards, and the child's fingers are not contained within the first appendage component. The bottle holder assembly still further includes a retention component configured to retain a bottle, and including one or more coupling fasteners. The coupling fastener of each appendage component is capable of being removably secured to the one or more coupling fasteners of the retention component.

16 Claims, 9 Drawing Sheets

U.S. PATENT DOCUMENTS

| | | | | |
|---|---|---|---|---|
| 7,211,004 | B2 * | 5/2007 | DeMarco | 473/201 |
| 7,213,791 | B2 * | 5/2007 | Morris et al. | 248/102 |
| 7,334,711 | B1 * | 2/2008 | Winters | 224/217 |
| 7,419,125 | B2 * | 9/2008 | Simone | 248/102 |
| D633,215 | S * | 2/2011 | Steele | D24/199 |
| 8,191,210 | B2 * | 6/2012 | Devers | 24/265 WS |
| 2004/0205875 | A1 * | 10/2004 | Byrne et al. | 2/16 |

* cited by examiner

BOTTLE HOLDER ASSEMBLY AND METHODS OF USE

CROSS-REFERENCE TO RELATED APPLICATION

The present application is a U.S. nonprovisional patent application of, and claims priority under 35 U.S.C. §119(e) to, U.S. provisional patent application Ser. No. 61/246,794, filed Sep. 29, 2009, which provisional patent application is incorporated by reference herein. The present application also incorporates herein by reference Appendices A, B, C, D, E, and F, which appendices are attached hereto.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to a bottle holder system for assisting a child in feeding himself or herself with a bottle.

A need exists for improvement in bottle holder systems. This, and other needs, are addressed by one or more aspects of the present invention.

SUMMARY OF THE INVENTION

The present invention includes many aspects and features. Moreover, while many aspects and features relate to, and are described in, the context of a bottle holder, the present invention is not limited to use only in such context, as will become apparent from the following summaries and detailed descriptions of aspects, features, and one or more embodiments of the present invention.

Accordingly, one aspect of the present invention relates to a bottle holder assembly. The bottle holder assembly includes a first appendage component configured to be secured about a child's left hand via removable securement of one or more securement fasteners such that a coupling fastener is disposed over a child's palm facing outwards, and the child's fingers are not contained within the first appendage component. The bottle holder assembly further includes a second appendage component configured to be secured about a child's right hand via removable securement one or more securement fasteners such that a coupling fastener is disposed over a child's palm facing outwards, and the child's fingers are not contained within the first appendage component. The bottle holder assembly still further includes a retention component configured to retain a bottle, and including one or more coupling fasteners. The coupling fastener of each appendage component is capable of being removably secured to the one or more coupling fasteners of the retention component.

In a feature of this aspect of the invention, each component of the bottle holder assembly is generally flat.

Another aspect of the present invention relates to a bottle holder assembly. The bottle holder assembly includes at least one appendage component. Each appendage component includes a first flexible portion having a first side including a first fastener component, and having a second side including a second fastener component, as well as a second flexible portion, which is secured to, or integrally formed, with, the first flexible portion, and has a first side including a first fastener component, a second side including a second fastener component, and a length greater than a length of the first flexible portion, and extends non-perpendicularly from a non-end section of the first flexible portion. The bottle holder assembly further includes a flexible retention component having a first side including one or more fastener components, and a second side including a fastener component. For each at least one appendage component, the first fastener component of the first side of the first flexible portion and the first fastener component of the first side of the second flexible portion are each configured to mate with the second fastener component of the second side of the first flexible portion. Each at least one appendage component is capable of being secured about a child's hand, via removable securement of the first fastener component of the first side of the first flexible portion and the first fastener component of the first side of the second flexible portion to the second fastener component of the second side of the first flexible portion, such that the second fastener component of the second side of the second flexible portion is disposed over the child's palm facing outwards. Further, the fastener component of the second side of the flexible retention component is configured to mate with the one or more fastener components of the first side of the flexible retention component. The flexible retention component is capable of being formed into a retention sleeve via removable securement of the fastener component of the second side of the flexible retention component to the one or more fastener components of the first side of the flexible retention component. Additionally, such a formed retention sleeve is capable of retaining a bottle therein, and each at least one appendage component, when secured about a child's hand, is capable of being removably secured to such a formed retention sleeve, when having a bottle retained therein, via securement of the second fastener component of the second side of the second flexible portion to the one or more fastener components of the first side of the flexible retention component.

In addition to the aforementioned aspects and features of the present invention, it should be noted that the present invention further encompasses the various possible combinations and subcombinations of such aspects and features.

BRIEF DESCRIPTION OF THE DRAWINGS

One or more preferred embodiments of the present invention now will be described in detail with reference to the accompanying drawings, wherein the same elements are referred to with the same reference numerals, and wherein.

DETAILED DESCRIPTION

Figure 1:
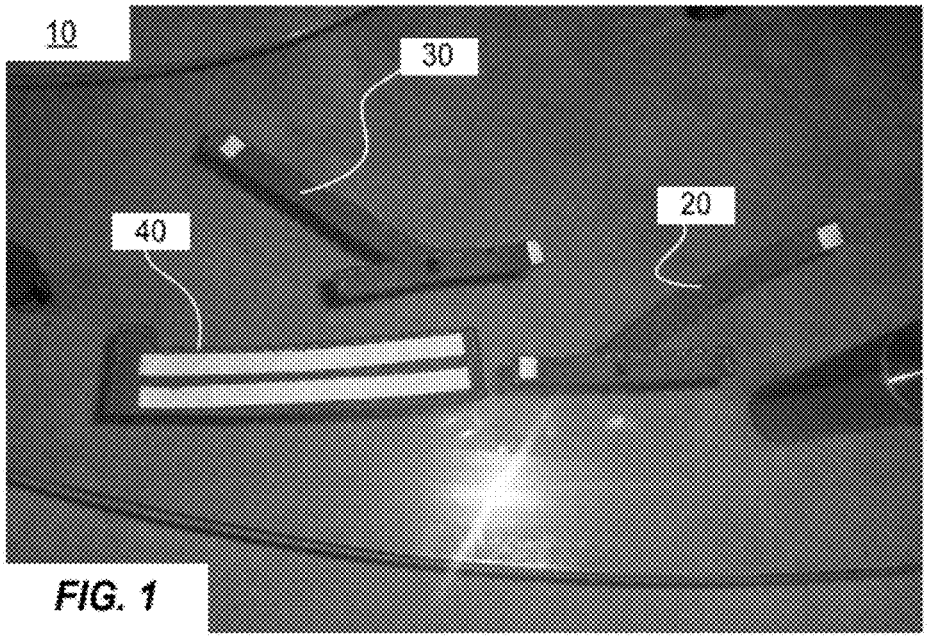
FIG. 1 is a photograph of a first side of components of a bottle holder assembly in accordance with one or more preferred aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
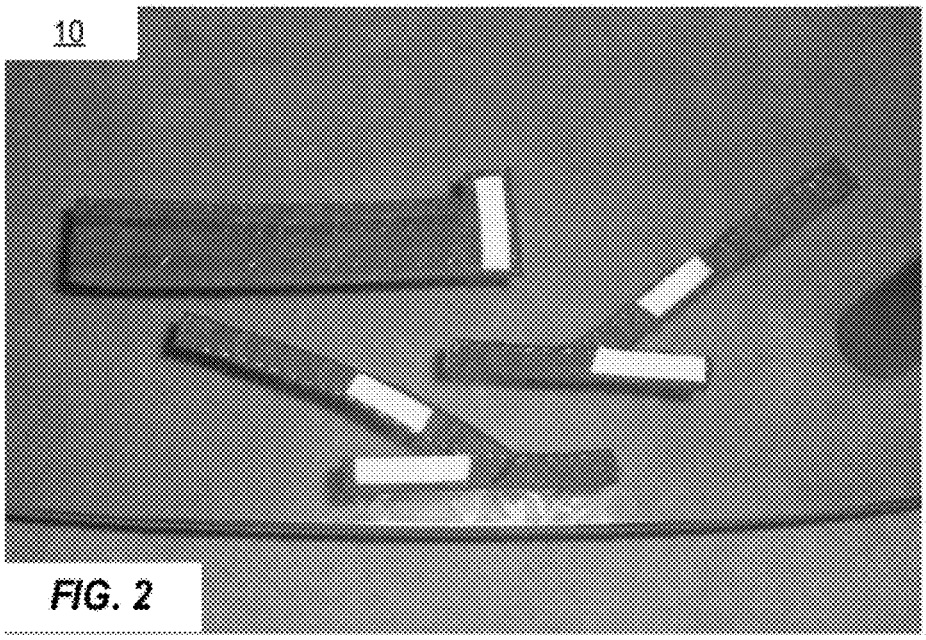
FIG. 2 is a photograph of a second, opposite, side of components of the bottle holder assembly of FIG. 1.

Turning now to the figures, FIGS. 1 and 2 show, respectively, first and second sides of components of a bottle holder assembly 10 in accordance with one or more preferred aspects of the present invention. The bottle holder assembly 10 includes a first appendage component 20, a second appendage component 30, and a retention component 40. Notably, although described herein largely in the context of a bottle holder system comprising two appendage components, in at least some preferred implementations a bottle holder assembly might include only a single appendage component.

Figure 3:
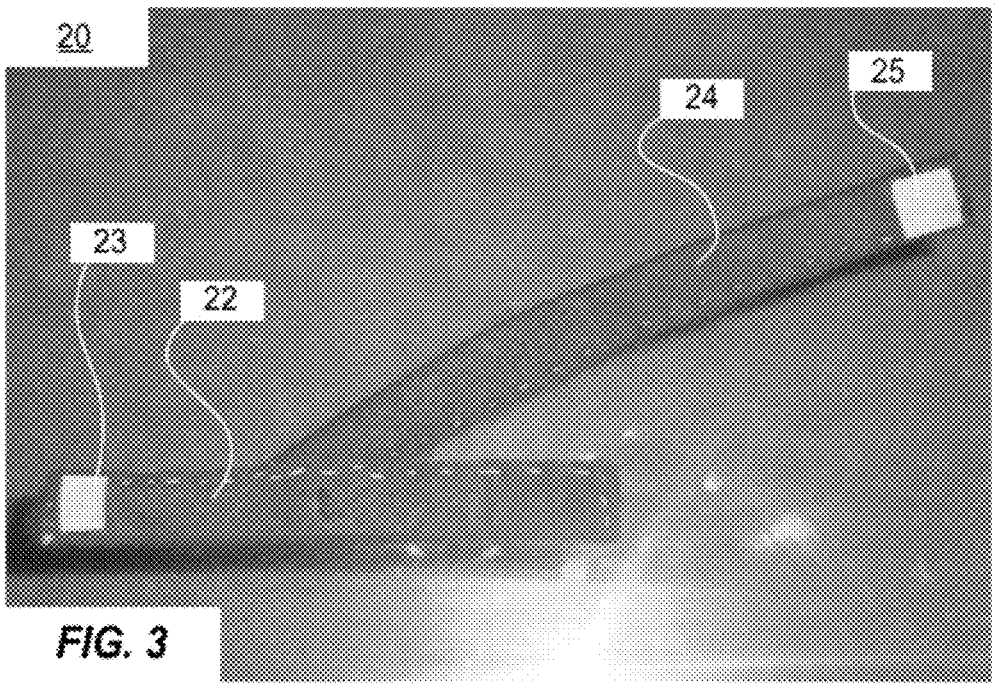
FIG. 3 is a photograph of a first side of a first appendage component of the bottle holder assembly of FIG. 1.
Figure 4:
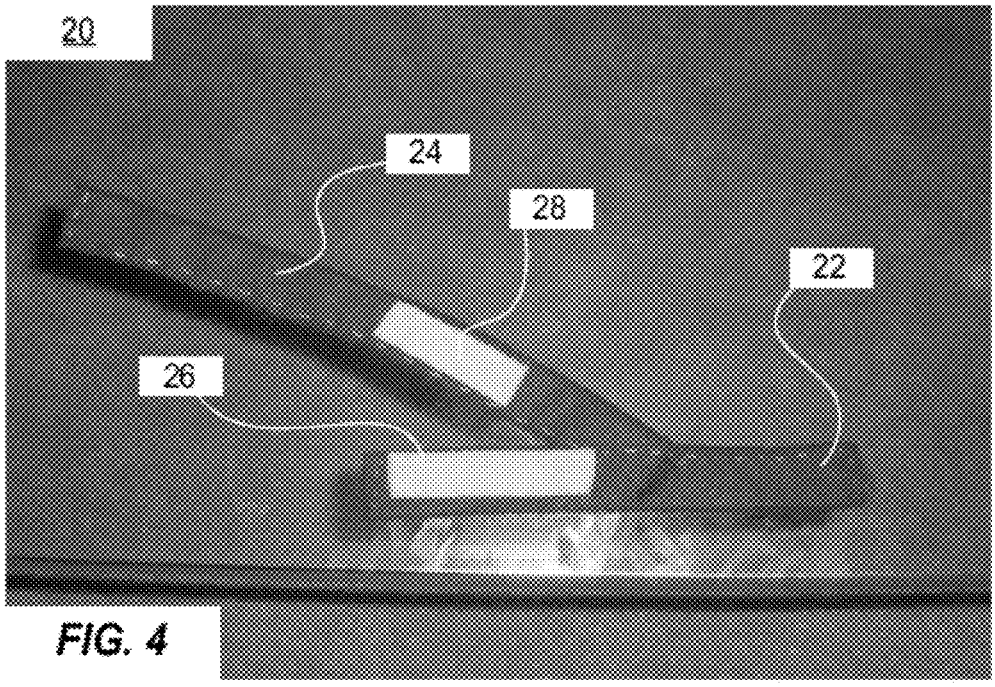
FIG. 4 is a photograph of a second, opposite, side of the appendage component of FIG. 3.

The first appendage component 20 comprises flexible portions 22,24 of textile material sewn together as can be seen in FIGS. 3 and 4, which show, respectively, first and second sides of the first appendage component 20. Preferably, each of the flexible portions 22,24 comprises a pliable textile material, such as, for example, a felt-like or cotton material. In at least some alternative implementations, however, the flexible portions may comprise an elastomeric material or plastic.

The flexible portion 24 is preferably secured to the flexible portion 22 generally proximate a lengthwise middle of the flexible portion 22 as shown in FIGS. 3 and 4. Preferably, the flexible portion 24 is secured to the flexible portion 22 such that the flexible portion 24 is not generally perpendicular to the flexible portion 22, although in at least one alternative implementation the flexible portion 22 is secured to the flexible portion 24 such that the flexible portion 24 is generally perpendicular to the flexible portion 22.

In at least some preferred implementations, rather than being sewn together, flexible portions of an appendage component may be attached together in another manner.

Further, although described in the context of an appendage component comprising two flexible portions, in alternative implementations, an appendage component may comprise more or less flexible portions. In at least some preferred implementations, an appendix component may comprise one or more flexible portions. In at least one preferred implementation, an appendage component includes only one flexible portion.

Returning to FIG. 3, the first side of the first appendage component 20 includes fastener components 23,25. Specifically, a first side of the flexible portion 22 includes fastener component 23, and a first side of the flexible portion 24 includes fastener component 25. Preferably, fastener components 23,25 are located at opposite ends of their respective portions 22,24, as illustrated, although, in at least some alternative implementations, fastener components 23,25 may be positioned differently.

The second side of the first appendage component 20 includes fastener component 26. More specifically, the second side of the flexible portion 22 includes fastener component 26. Preferably, each fastener component 23,25 of the first side of the first appendage component 20 is configured to mate with fastener component 26 of the second side of the first appendage component 20, although in at least one alternative implementation rather than having a single fastener component such as fastener component 26 configured for securing two fastener components, an appendage component may include two sets of mating fastener components.

Preferably, each fastener component 23,25 comprises one of a hook or loop fastener component, and fastener component 26 comprises the other of a hook or loop fastener component, such that each of fastener components 23,25 is configured to mate with fastener component 26.

The flexible portion 24 further includes fastener component 28, which is preferably a hook or loop fastener component configured to mate with a hook or loop fastener component of the retention component 40, as described in more detail hereinbelow.

In alternative preferred implementations, fastener components 23,25,26,28 may comprise other types of fastener components, such as, for example, magnetic fastener components.

Figure 5:
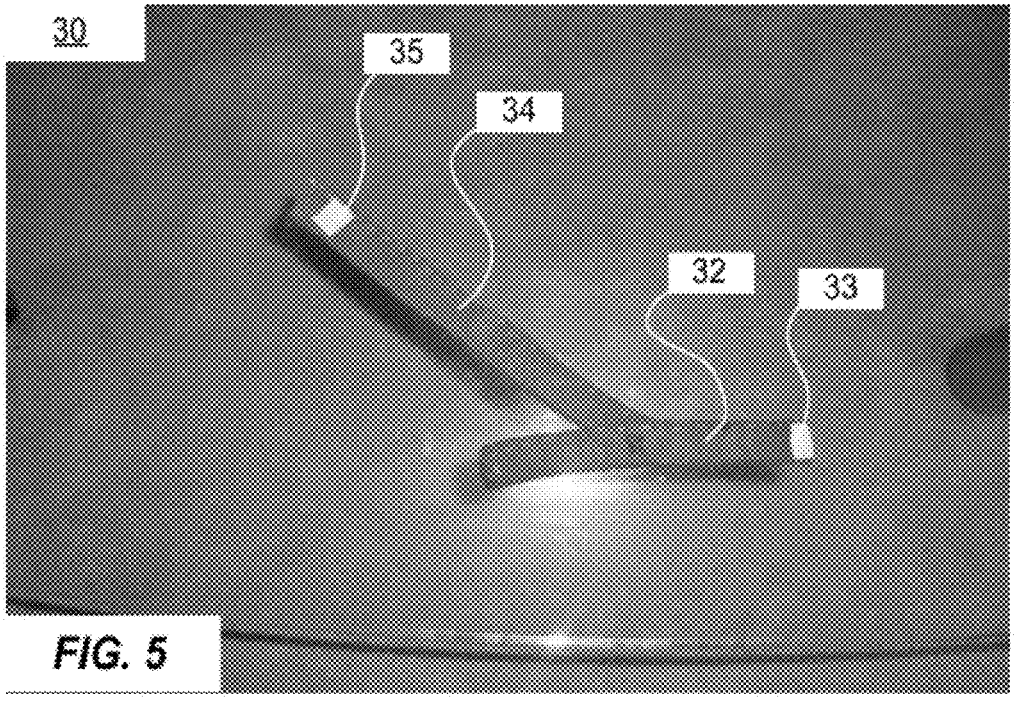
FIG. 5 is a photograph of a first side of a second appendage component of the bottle holder assembly of FIG. 1.
Figure 6:
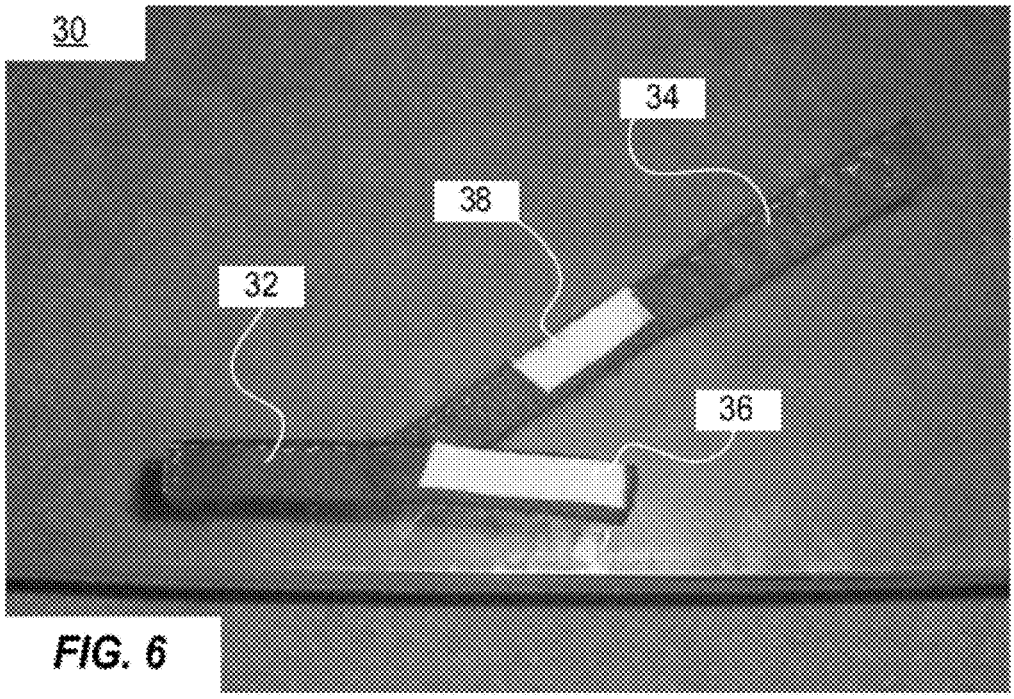
FIG. 6 is a photograph of a second, opposite side of the appendage component of FIG. 5.

FIGS. 5 and 6 show, respectively, first and second sides of the second appendage component 30, which is substantially similar to the first appendage component 20, except in that it appears to have been "flipped" about a vertical axis with respect to the figures. More specifically, like first appendage component 20, second appendage component 30 includes first and second flexible portions 32,34 secured to one another at an angle. However, if respective angle measurements are taken from a right side of flexible portions 22,32 to flexible portions 24,34, the measured angle at which flexible portions 32,34 are secured to one another is supplementary to the measured angle at which flexible portions 22,24 are secured to one another, i.e. the two angles add up to one hundred and eighty degrees.

Preferably, the first appendage component 20 is configured for securement about a child's left hand, while the second appendage component 30 is configured for securement about a child's right hand. Notably, however, in at least some preferred implementations, such as, for example, the preferred implementation shown in FIG. 1, both appendage components 20,30 are capable of being secured about either the left or right hand of a child. In at least some implementations, the appendage components are capable of performing as described hereinbelow when so secured about either hand. Further, in at least some alternative implementations, the bottle holder assembly 10 includes two identical appendage components.

Figure 7:
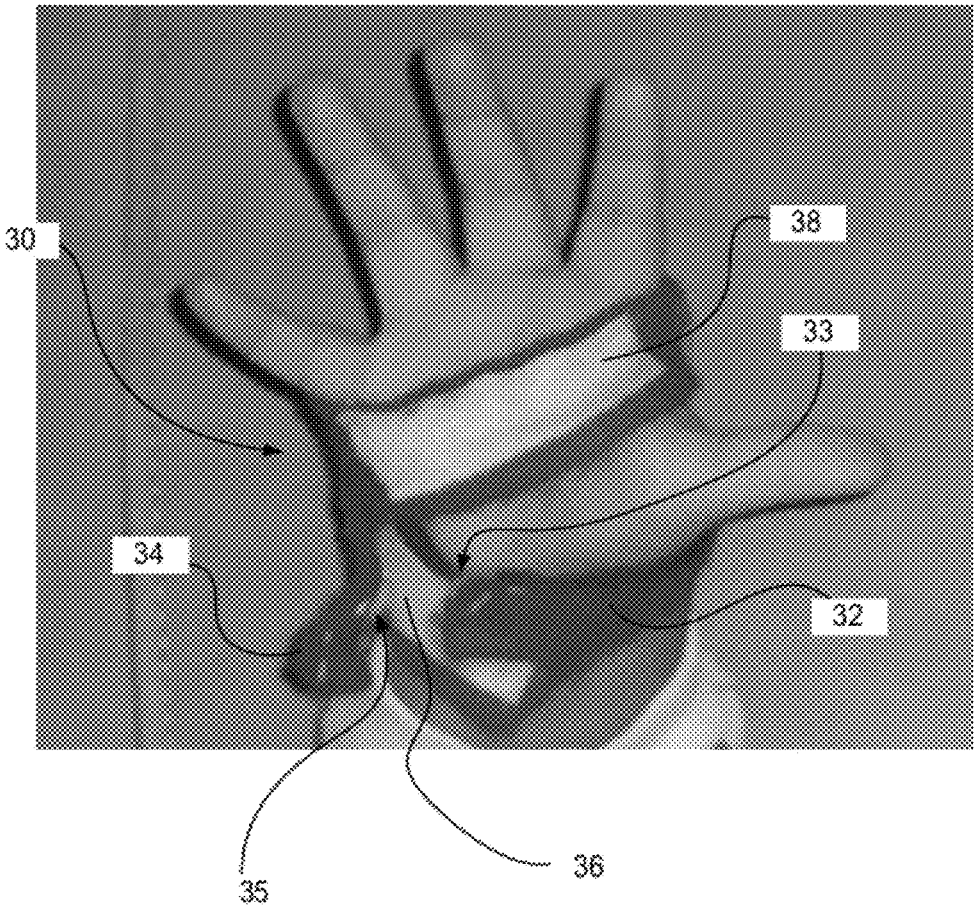
FIG. 7 is a photograph of the second appendage component of FIG. 5 retained about a child's right hand.

In use, appendage components are capable of being secured to or about a child's hand. FIG. 7 shows appendage component 30 secured to a child's right hand via securement of fastener components 33,35 to fastener component 36.

Preferably, flexible portion 32 is first wrapped around a child's wrist such that fastener component 36 is facing away from the child's skin, and flexible portion 32 is then secured to itself via securement of fastener component 33 to fastener component 36. As shown, fastener component 36 is sized and dimensioned such that, following attachment of fastener component 33, sufficient space remains for attachment of another fastener component. Next, flexible portion 34 is positioned such that fastener component 38 is disposed over the child's palm facing outwards away from the child's skin, then flexible portion 34 is wrapped back around and under the child's hand, and fastener component 35 is secured to fastener component 36.

Figure 8:
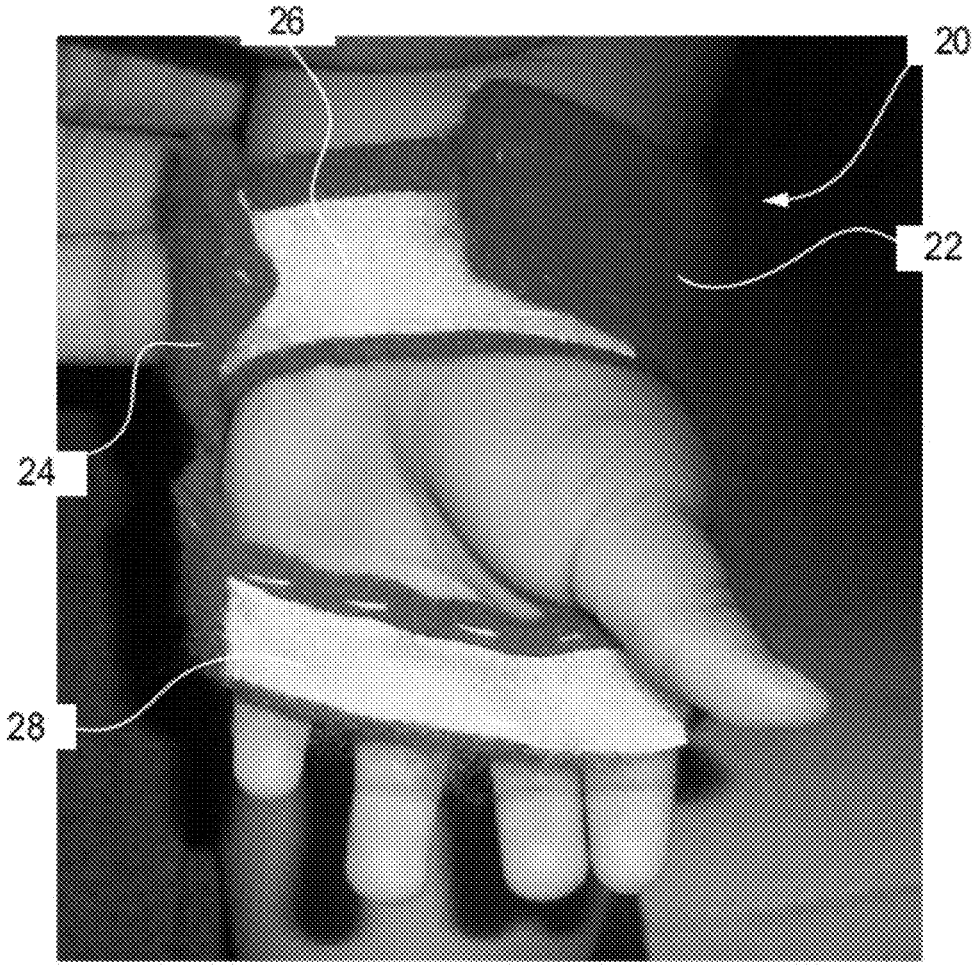
FIGS. 8-9 are photographs of the first appendage component of FIG. 3 retained about a child's left hand.
Figure 9:
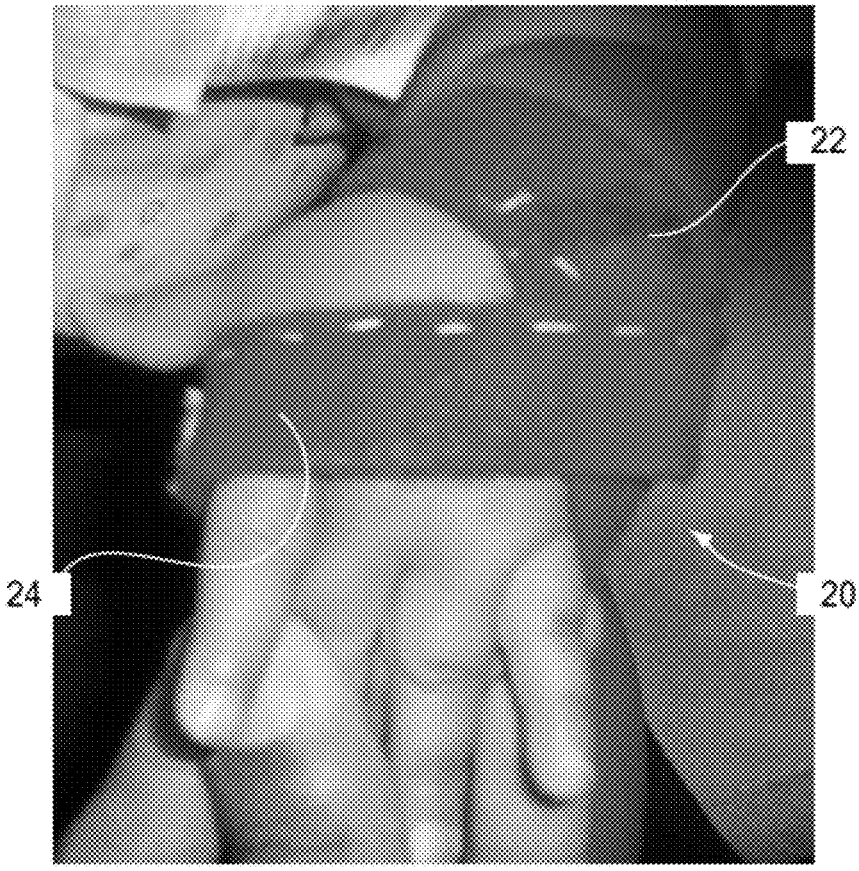

Similarly, FIGS. 8 and 9 show appendage component 20 secured to a child's left hand via securement of fastener components 23,25 to fastener component 26.

Figure 10:
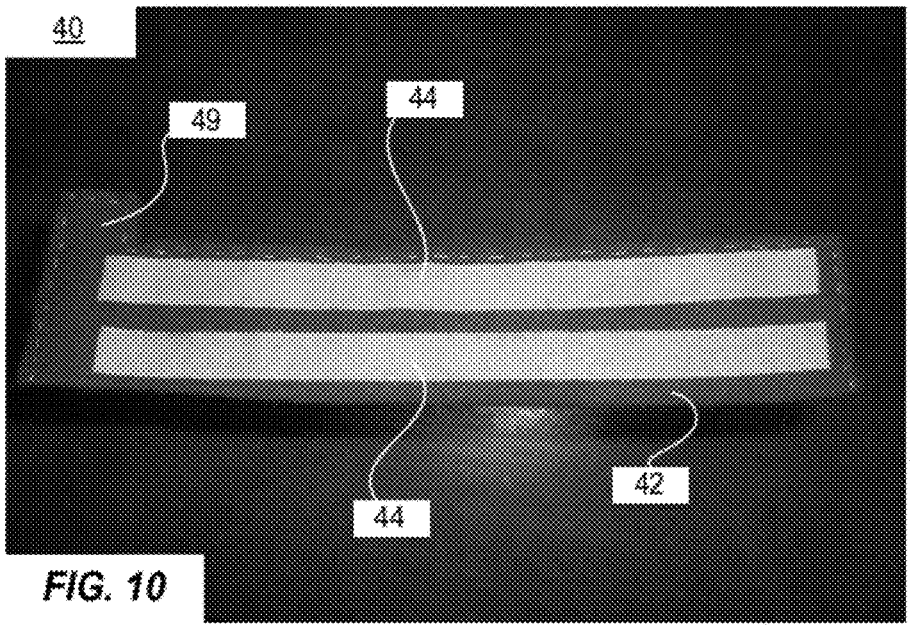
FIG. 10 is a photograph of a first side of a retention component of the bottle holder assembly of FIG. 1.
Figure 11:
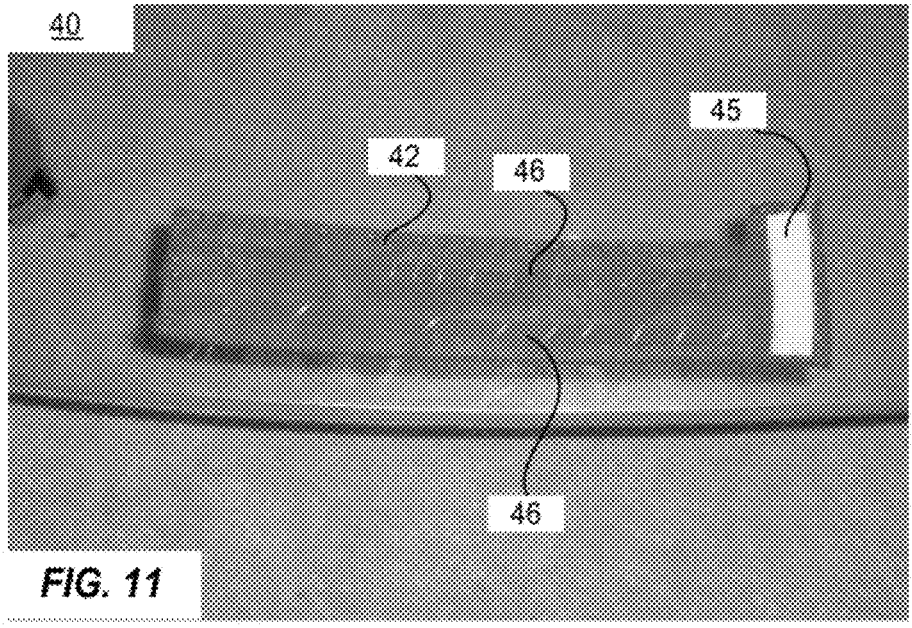
FIG. 11 is a photograph of a second, opposite, side of the retention component of FIG. 10.

The bottle holder assembly 10 further includes retention component 40, first and second sides of which are shown, respectively, in FIGS. 10 and 11. Retention component 40 includes a retention member 42 comprising a pliable textile material, such as, for example, a felt-like or cotton material. In at least some alternative implementations, however, a retention member may comprise an elastomeric material or plastic.

The first side of retention component 40 includes one or more fastener components 44. Fastener components 44 of the first side of the retention component 40 are configured to mate with a fastener component 45 of the second side of the retention component. In a preferred implementation, the retention member 42 includes a tab 49 defined by the top edge (according to the view shown in FIG. 8) of the retention member 42, and, preferably, any fastener components 44 of the first side of the retention member 42 generally do not extend into the area below the tab 49, and fastener component 45 is located on and vertically below (according to the view shown in FIG. 9) the tab 49, as shown in FIG. 9.

Preferably, fastener components 44 comprise one of hook or loop fastener components running generally lengthwise along the extent of the first side of the retention member 42, and fastener component 45 comprises the other of hook or loop fastener components, such that each fastener component 44 is configured to mate with fastener component 45. In at least one implementation, magnetic fastener components may, additionally or alternatively, be utilized.

The second side of retention component 40 preferably further includes one or more gripping members 46 which extend generally along the length of the retention component 40, except in that they do not extend below the tab 49. The gripping members 46 comprise a high grip or non-slip material, such as a high grip or non-slip, elastomeric or polymeric material. In a preferred implementation, one or more materials are selected for a gripping member such that the gripping member has a high coefficient of friction with materials a bottle might be constructed from, such as, for example, a rubber gripping member for use with a plastic bottle. In at least some alternative implementations, only one gripping member might be used, while in other implementations, a plurality of gripping members might be used. In at least one preferred implementation, no gripping member is used, and, in at least one preferred implementation, substantially all of one of the sides of the retention component comprises a high grip or non-slip material, possibly excepting the fastener component disposed on that side.

In use, retention component 40 is preferably positioned such that it defines a generally cylindrical sleeve with gripping members 46 located on an inside surface of the sleeve, and retention component 40 is then secured to itself via securement of fastener components 44 to fastener components 44.

Figure 12:
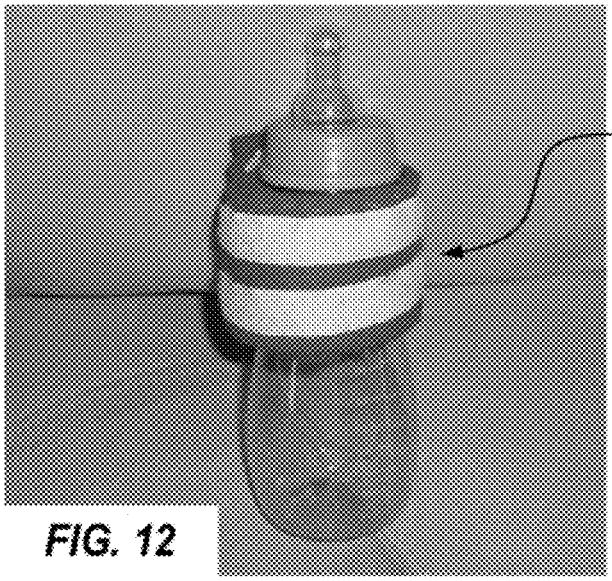
FIG. 12 is a photograph of the retention component of FIG. 10 secured about a bottle.

Preferably, a bottle is located within retention component 40 when it is being secured to itself, and such securement comprises wrapping the retention component 40 tightly around the bottle and then securing the retention component 40 to itself such that the bottle is retained therein, as illustrated in FIG. 12.

Figure 13:
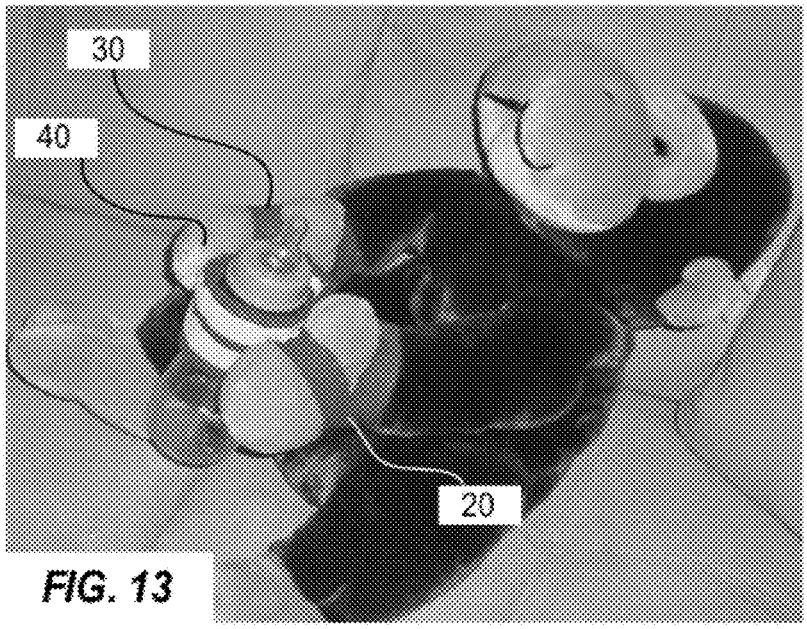
FIG. 13 is a photograph illustrating securement of the appendage components of the bottle holder assembly of FIG. 1 to the retention component of the bottle holder assembly of FIG. 1.

Preferably, this occurs either before or after appendage components 20,30 have been secured about a child's hands. Appendage components 20,30 are then secured to retention component 40 via securement of fastener components 28,38 to fastener components 44, as illustrated in FIG. 13. Notably, in at least some preferred implementations in which fastener components 28,38 are secured over a child's palm, securement of the appendage components 20,30 simulates the holding of the bottle by the child by placing the bottle in the same general position that the child would preferably utilize to hold the bottle if they had sufficient strength and dexterity to do so. It is believed that such positioning represents a natural position.

Figure 14:
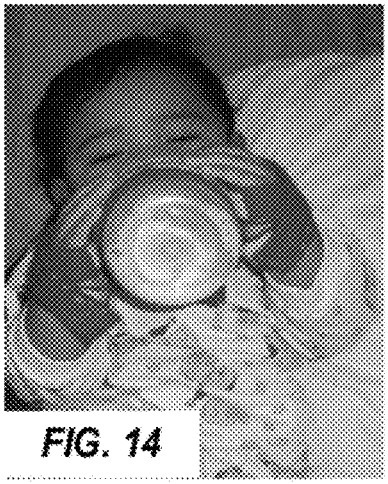
FIG. 14 is a photograph showing a child wrapping their fingers around a bottle to the extent possible while utilizing the bottle holder assembly of FIG. 1.

That is, such securement simulates holding of the bottle in the palm of the child's hands, and allows the child to wrap his or her fingers around the bottle, to the extent physically possible, as illustrated in FIG. 14. Such positioning teaches the child a position in which the bottle can be held, and facilitates learning of how to hold a bottle, and how to feed ones' self with a bottle.

As a child utilizes this system to feed themselves via a bottle, the child learns the hand positions needed by both hands to hold the bottle for feeding. Further, use of this bottle holder assembly for feeding increases the coordination of the child, ultimately teaching the child how to hold the bottle on their own without the system, e.g. creating the muscle memory needed for the child to eventually feed himself or herself without use of the bottle holder assembly.

Figure 15:
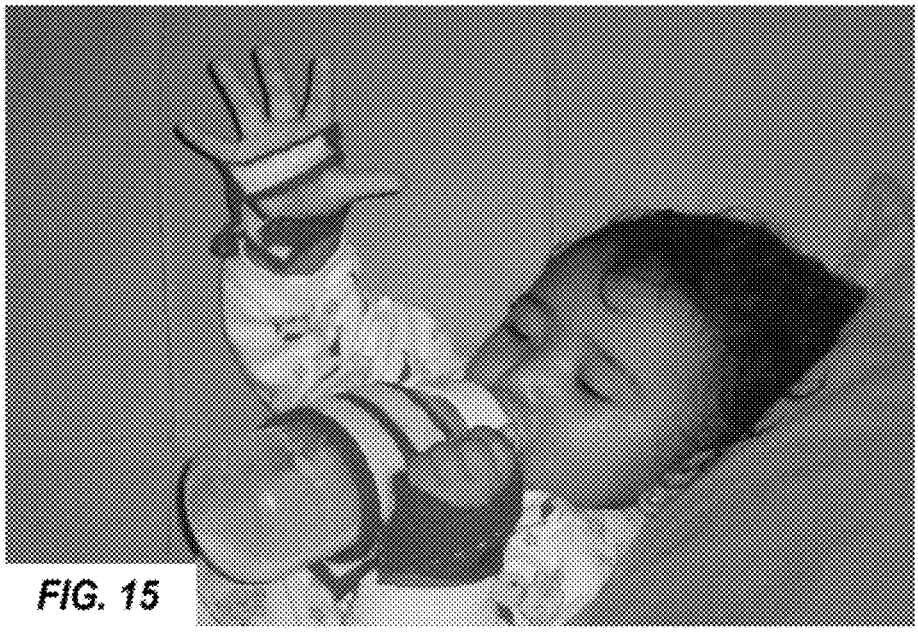
FIG. 15 is a photograph showing a child having removed one appendage component from securement with the retention component of the bottle holder assembly of FIG. 1.

In at least some preferred implementations, the fastener components of a bottle holder assembly are sufficiently strong so as to prevent inadvertent unsecurement, but sufficiently weak so as to allow a child to unsecure the appendage components from the retention component on their own, as illustrated by FIG. 15.

Notably, the configuration of appendage components allows a child who has unsecured a hand to use that hand in a relatively unencumbered manner. For example, the child's fingers are not limited in mobility, dexterity, or tactile sensation as they might be inside of a glove or mitten.

In preferred methods of use, the bottle holder assembly is utilized while a child is riding in a car and a parent cannot cease driving to feed the child; at night, when a child wakes up; or while a child is in a stroller, and a parent is pushing the stroller.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A bottle holder assembly comprising:

(a) first and second appendage components each comprising (i) a first flexible band, and (ii) a second flexible band, an end of the second flexible band being secured to the first flexible band proximate a middle of the first flexible band such that the second flexible band extends generally non-perpendicularly from the first flexible band, (iii) wherein each appendage component is configured to be transitionable between (A) a first configuration, in which it is capable of lying generally flat, and (B) a second configuration, in which it is secured about a child's hand via removable securement of one or more securement fasteners such that (1) the first flexible band is secured about the child's wrist, (2) the second flexible band is secured about the child's hand such that a portion of the second flexible band which includes a coupling fastener is disposed over the child's palm facing outwards, (3) the child's fingers are not contained within the first appendage component, and (4) a portion of the child's palm remains uncovered;

(b) a retention component configured to retain a bottle, and including one or more coupling fasteners;

(c) wherein the coupling fastener of each appendage component is capable of being removably secured to the one or more coupling fasteners of the retention component.

2. The bottle holder assembly of claim 1, wherein each component of the bottle holder assembly is generally flat.

3. A bottle holder assembly comprising:

(a) at least one appendage component, each appendage component comprising (i) a first generally linear flexible band (A) having a first side including a first fastener component, and (B) having a second side including a second fastener component; and (ii) a second generally linear flexible band, said second flexible band (A) being secured to, or integrally formed, with, said first flexible band, (B) having a first side including a first fastener component, (C) having a second side including a second fastener component, (D) having a length greater than a length of said first flexible portion, and (E) extending non-perpendicularly from a non-end section of said first flexible portion; and (b) a flexible retention component (i) having a first side including one or more fastener components, (ii) having a second side including a fastener component;

(c) wherein, for each at least one appendage component, the first fastener component of the first side of the first flexible band and the first fastener component of the first side of the second flexible band are each configured to mate with the second fastener component of the second side of the first flexible band;

(d) wherein each at least one appendage component is capable of being secured about a child's hand, via removable securement of the first fastener component of the first side of the first flexible band and the first fastener component of the first side of the second flexible band to the second fastener component of the second side of the first flexible band, such that the second fastener component of the second side of the second flexible band is disposed over the child's palm facing outwards;

(e) wherein the fastener component of the second side of the flexible retention component is configured to mate with the one or more fastener components of the first side of the flexible retention component;

(f) wherein the flexible retention component is capable of being formed into a retention sleeve via removable securement of the fastener component of the second side of the flexible retention component to the one or more fastener components of the first side of the flexible retention component;

(g) wherein such a formed retention sleeve is capable of retaining therein a bottle; and (h) wherein each at least one appendage component, when secured about a child's hand, is capable of being removably secured to such a formed retention sleeve, when having a bottle retained therein, via securement of the second fastener component of the second side of the second flexible band to the one or more fastener components of the first side of the flexible retention component.

4. A bottle holder assembly comprising:

(a) first and second appendage components each comprising (i) a first textile strip, and (ii) a second textile strip, an end of the second textile strip being secured to the first textile strip proximate a middle of the first textile strip such that the second textile strip extends generally non-perpendicularly from the first textile strip, (iii) wherein each appendage component is configured to be transitionable between (A) a first configuration, in which it is capable of lying generally flat, and (B) a second configuration, in which it is secured about a baby's hand via removable securement of one or more securement fasteners such that (1) the first textile strip is secured about the baby's wrist, (2) the second textile strip is secured about the baby's hand such that a portion of the second textile strip which includes a coupling fastener is disposed over the baby's palm facing outwards, (3) the baby's fingers are not contained within the first appendage component, and (4) a portion of the baby's palm remains uncovered;

(b) a retention component configured to retain a bottle, and including one or more coupling fasteners;

(c) wherein the coupling fastener of each appendage component is capable of being removably secured to the one or more coupling fasteners of the retention component;

(d) wherein each appendage component is sized and dimensioned for a baby's hand.

5. The bottle holder assembly of claim 1, wherein the securement fasteners include hook and loop fastener components.

6. The bottle holder assembly of claim 1, wherein each flexible band comprises a pliable, textile material.

7. The bottle holder assembly of claim 1, wherein each flexible band comprises an elastomeric material.

8. The bottle holder assembly of claim 1, wherein each flexible band comprises plastic.

9. The bottle holder assembly of claim 1, wherein the securement fasteners include magnetic fastener components.

10. The bottle holder assembly of claim 3, wherein the fastener components include hook and loop fastener components.

11. The bottle holder assembly of claim 3, wherein each flexible band comprises a pliable, textile material.

12. The bottle holder assembly of claim 3, wherein each flexible band comprises an elastomeric material.

13. The bottle holder assembly of claim 3, wherein each flexible band comprises plastic.

14. The bottle holder assembly of claim 3, wherein the fastener components include magnetic fastener components.

15. The bottle holder assembly of claim 4, wherein the securement fasteners include hook and loop fastener components.

16. The bottle holder assembly of claim 4, wherein the securement fasteners include magnetic fastener components.

* * * * *